US007951515B2

(12) United States Patent
Wu et al.

(10) Patent No.: US 7,951,515 B2
(45) Date of Patent: May 31, 2011

(54) ESTER THIOLS CONTAINING PHOTOGENERATING LAYER PHOTOCONDUCTORS

(75) Inventors: Jin Wu, Webster, NY (US); Marc J Livecchi, Rochester, NY (US); Linda L Ferrarese, Rochester, NY (US); John J Wilbert, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 379 days.

(21) Appl. No.: 12/276,670

(22) Filed: Nov. 24, 2008

(65) Prior Publication Data

US 2010/0129744 A1 May 27, 2010

(51) Int. Cl.
*G03G 5/06* (2006.01)
*G03G 15/02* (2006.01)

(52) U.S. Cl. ..... 430/59.1; 430/57.1; 430/96; 430/135

(58) Field of Classification Search ..... 430/57.1, 430/59.1, 96, 135
See application file for complete search history.

(56) References Cited

U.S. PATENT DOCUMENTS 4,265,990 A 5/1981 Stolka et al.
4,587,189 A 5/1986 Hor et al.
5,473,064 A 12/1995 Mayo et al.
5,482,811 A 1/1996 Keoshkerian et al.
5,521,306 A 5/1996 Burt et al.
6,913,863 B2 7/2005 Wu et al.
2007/0059621 A1 * 3/2007 Wu et al. ..... 430/60
2007/0161728 A1 7/2007 Starnes, Jr.

OTHER PUBLICATIONS

Jin Wu, U.S. Appl. No. 12/129,958, on Anthracene Containing Photoconductors, filed May 30, 2008.

Jin Wu, U.S. Appl. No. 12/129,965, on Ferrocene Containing Photoconductors, filed May 30, 2008.

Jin Wu, U.S. Appl. No. 12/129,982, on Zirconocene Containing Photoconductors, filed May 30, 2008.

Jin Wu et al., U.S. Appl. No. 11/869,231, on Additive Containing Photogenerating Layer Photoconductors, filed Oct. 9, 2007.

Liang-Bih Lin et al., U.S. Appl. No. 11/800,129, on Photoconductors, filed May 4, 2007.

* cited by examiner

*Primary Examiner* — Hoa V Le
(74) *Attorney, Agent, or Firm* — Oliff & Berridge, PLC

(57) ABSTRACT

A photoconductor that includes, for example, a supporting substrate, a photogenerating layer, and at least one charge transport layer, and where the photogenerating layer contains at least one photogenerating component, and a mixture of an ester thiol and a poly(vinyl halide) copolymer.

32 Claims, No Drawings

ESTER THIOLS CONTAINING PHOTOGENERATING LAYER PHOTOCONDUCTORS

CROSS REFERENCE TO RELATED APPLICATIONS

Copending U.S. application Ser. No. 12/129,958 on Anthracene Containing Photoconductors, filed May 30, 2008, the disclosure of which is totally incorporated herein by reference.

Copending U.S. application Ser. No. 12/129,965 on Ferrocene Containing Photoconductors, filed May 30, 2008, the disclosure of which is totally incorporated herein by reference.

Copending U.S. application Ser. No. 12/129,982 on Zirconocene Containing Photoconductors, filed May 30, 2008, the disclosure of which is totally incorporated herein by reference.

Copending U.S. application Ser. No. 11/869,231 on Additive Containing Photogenerating Layer Photoconductors, filed Oct. 9, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains at least one of an ammonium salt and an imidazolium salt.

Copending U.S. application Ser. No. 11/800,129 on Photoconductors, filed May 4, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a bis(pyridyl)alkylene.

BACKGROUND

This disclosure is generally directed to imaging members, photoreceptors, photoconductors, and the like that can be selected for a number of machines, such as copiers and printers, especially xerographic machines. More specifically, the present disclosure is directed to drum, multilayered drum, or flexible, belt imaging members, or devices comprised of a supporting medium like a substrate, a photogenerating layer, and a charge transport layer, including a plurality of charge transport layers, such as a first charge transport layer and a second charge transport layer, and wherein the photogenerating layer contains a mixture of a suitable polymeric binder and an ester thiol; and a photoconductor comprised of a supporting medium like a substrate, a mixture of a stabilized polymeric binder and an ester thiol containing photogenerating layer, and a charge transport layer that results in photoconductors with a number of advantages, such as in embodiments, the minimization or substantial elimination of undesirable ghosting on developed images, such as xerographic images, including excellent ghosting characteristics at various relative humidities; excellent cyclic and stable electrical properties; minimal charge deficient spots (CDS); compatibility with the photogenerating and charge transport resin binders; and acceptable lateral charge migration (LCM) characteristics, such as for example, excellent LCM resistance. At least one charge transport layer in embodiments refers, for example, to one, to from 1 to about 10, to from 2 to about 6; to from 2 to about 4; 2, and the like.

Ghosting refers, for example, to when a photoconductor is selectively exposed to positive charges in a number of xerographic print engines, where some of these charges enter the photoconductor and manifest themselves as a latent image in the next printing cycle. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the photoconductor is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure.

The photoconductors disclosed herein are, in embodiments, sensitive in the wavelength region of, for example, from about 400 to about 900 nanometers, and in particular from about 650 to about 850 nanometers, thus diode lasers can be selected as the light source. Moreover, the photoconductors disclosed herein are, in embodiments, useful in high resolution color xerographic applications, particularly high-speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in numerous U.S. patents, such as U.S. Pat. No. 4,265,990, wherein there is illustrated an imaging member comprised of a photogenerating layer, and an aryl amine hole transport layer.

In U.S. Pat. No. 4,587,189, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically, about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

In U.S. Patent Publication 20070161728, based on an application filed on Jan. 11, 2007 and titled Organic Thiol Stabilizers and Plasticizers for Halogen Containing Polymers, there are disclosed stabilizers, such as an organic thiol, like dipentaerythritol hexakis(mercaptoacetate) for polyvinylchloride.

The appropriate components, such as the supporting substrates, the photogenerating layer components, the charge transport layer components, the overcoating layer components, and the like of the above-recited patents, may be selected for the photoconductors of the present disclosure in embodiments thereof.

SUMMARY

Disclosed are imaging members and photoconductors that contain a substantially stabilized polymer binder in the photogenerating layer, and where there are permitted the minimization or substantial elimination of undesirable ghosting on developed images, such as xerographic images, including minimal ghosting at various relative humidities, acceptable photoinduced discharge (PIDC) values, excellent lateral charge migration (LCM) resistance, reduced charge deficient spot counts (CDS), and excellent cyclic stability properties.

Additionally disclosed are flexible belt imaging members containing optional hole blocking layers comprised of, for example, amino silanes (throughout in this disclosure plural also includes nonplural, thus there can be selected a single amino silane), metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

The photoconductors illustrated herein, in embodiments, have acceptable image ghosting characteristics; low background and/or minimal charge deficient spots (CDS); and desirable toner cleanability.

EMBODIMENTS

Aspects of the present disclosure relate to a process for the preparation of a photoconductor which comprises depositing on a supporting substrate a photogenerating layer followed by the depositing on the photogenerating layer of at least one charge transport layer wherein the photogenerating layer is prepared by mixing at least one photogenerating pigment, a poly(vinyl halide) copolymer, and an ester thiol as represented by

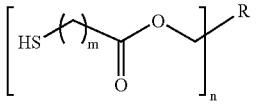

wherein R is selected from the group consisting of at least one of hydrogen, alkyl alkoxy, and aryl; n and m represent the number of groups, and where, for example, n is a number of from about 1 to about 12; and m is 1, 2, or 3; a photoconductor comprising a supporting substrate, a photogenerating layer, and at least one charge transport layer comprised of at least one charge transport component, and wherein the photogenerating layer contains at least one photogenerating component, and a mixture of an ester thiol and a poly(vinyl halide) polymer, and wherein the thiol is represented by

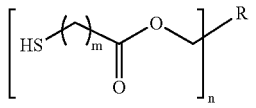

wherein R is at least one of hydrogen, alkyl, alkoxy, and aryl; n represents the number of repeating segments; and m represents the number of repeating groups; a photoconductor comprised in sequence of an optional supporting substrate, a photogenerating layer, and a charge transport layer; and wherein the photogenerating layer contains a mixture of a photogenerating pigment, a poly(vinyl chloride) copolymer, and an ester diol comprised of at least one of dipentaerythritol hexakis(mercaptoacetate), pentaerythritol tetrakis(3-mercaptopropionate), trimethylolpropane tris(3-mercaptopropionate), trimethylolpropane tris(2-mercaptoacetate), and methyl mercaptoacetate; a photoconductor comprising a supporting substrate, a photogenerating layer, and at least one charge transport layer comprised of at least one, such as one layer or two layers, charge transport component, and where the photogenerating layer contains at least one photogenerating component and the polymeric mixture as illustrated herein; a photoconductor comprising a supporting substrate; a mixture of a suitable polymeric binder and an ester thiol containing photogenerating layer; and a charge transport layer comprised of at least one charge transport component; a photoconductor comprised in sequence of an optional supporting substrate, a hole blocking layer, an adhesive layer, a mixture of a polyvinylhalide polymeric binder, and an ester thiol photogenerating layer, and a charge transport layer; a photoconductor wherein the charge transport component is an aryl amine selected from the group consisting of N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl) -[p-terphenyl]-4,4"-diamine, N,N'-diphenyl-N,N'-bis(3-chlorophenyl)-[p-terphenyl]-4,4"-diamine, and mixtures thereof; and wherein the at least one charge transport layer is from 1 to about 4; a photoconductor wherein the photogenerating pigment is a hydroxygallium phthalocyanine, a titanyl phthalocyanine, a halogallium phthalocyanine, or a perylene; a photoconductor wherein the ester thiol is present in the photogenerating layer in an amount of, for example, from about 0.1 to about 25, about 1 to about 15, and about 2 to about 10 weight percent; a photoconductor wherein the polyvinylhalide polymeric binder is present in the photogenerating layer in an amount of, for example, from about 20 to about 70, about 30 to about 60, and about 40 to about 50 weight percent; a photoconductor wherein the mixture of a polyvinylhalide polymeric binder and an ester thiol is present in the photogenerating layer in an amount of, for example, from about 20.1 to about 95, about 31 to about 75, and about 42 to about 60 weight percent; a photoconductor wherein the substrate is comprised of a conductive material, and a flexible photoconductive imaging member comprised in sequence of a supporting substrate, photogenerating layer thereover, a charge transport layer, and a protective top overcoat layer; and a photoconductor, which includes a hole blocking layer, and an adhesive layer where the adhesive layer is situated between the hole blocking layer and the photogenerating layer, and the hole blocking layer is situated between the substrate and the adhesive layer.

The present disclosure in embodiments thereof relates to a photoconductive member comprised of a supporting substrate, a photogenerating layer comprised of a photogenerating pigment, a mixture of an ester thiol and a VMCH polymer and an overcoating charge transport layer; a photoconductive member with a photogenerating layer of a thickness of from about 0.1 to about 10 microns, and at least one transport layer, each of a thickness of from about 50 to about 100 microns; a member wherein the thickness of the photogenerating layer is from about 0.1 to about 4 microns; a member wherein the polymeric binder mixture is present in an amount of from about 20 to about 90 percent by weight, and wherein the total of all layer components is about 100 percent; a member wherein the photogenerating component is a hydroxygallium phthalocyanine, a titanyl phthalocyanine, or a chlorogallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; a photoconductor wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor charge transport layer, especially a first and second charge transport layer, comprises

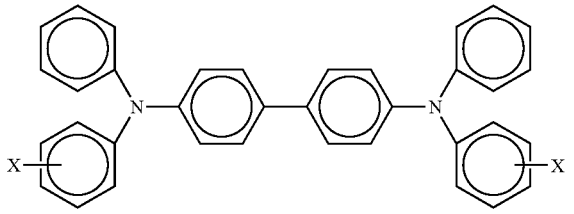

wherein X is selected from the group consisting of lower, that is with, for example, from 1 to about 8 carbon atoms, alkyl, alkoxy, aryl, and halogen; a photoconductor wherein each of, or at least one of the charge transport layers comprises

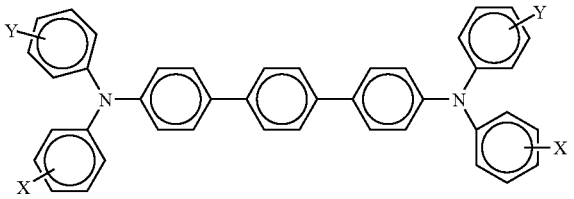

wherein X and Y are independently lower alkyl, lower alkoxy, phenyl, a halogen, or mixtures thereof; a photoconductor wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine photogenerating pigment has major peaks, as measured with an X-ray diffractometer (CuK alpha radiation wavelength equals 0.1542 nanometers) at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on the photoconductor illustrated herein; developing the latent image, and transferring the developed electrostatic image to a suitable substrate; a method of imaging wherein the imaging member is exposed to light of a wavelength of from about 370 to about 950 nanometers; a member wherein the photogenerating layer is of a thickness of from about 0.1 to about 50 microns; a member wherein the photogenerating pigment is dispersed in from about 1 weight percent to about 80 weight percent of the polymer mixture binder; a member wherein the binder mixture is present in an amount of from about 30 to about 70 percent by weight, and wherein the total of the layer components is about 100 percent; a photoconductor wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductive imaging member comprised of a supporting substrate, a photogenerating layer of VMCH, stabilized with an ester thiol, a hole transport layer, and in embodiments wherein a plurality of hole transport layers is selected, such as for example, from 2 to about 10, and more specifically 2 may be selected; and a photoconductive imaging member comprised of an optional supporting substrate, a photogenerating layer, and a first, second, and third charge transport layer.

Ester Thiol Component Examples

Examples of ester thiols that can be selected for incorporation into the photogenerating layer are illustrated with reference to the following

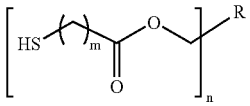

wherein R independently represents hydrogen, an alkyl or substituted alkyl group with, for example, from about 1 to about 20, from 1 to about 10, and more specifically, lower alkyl with from 1 to about 6 carbon atoms; an aryl or substituted aryl group with, for example, from about 6 to about 48, from 6 to about 36, from 6 to about 24, and from 7 to about 18 carbon atoms; m represents the number of repeating groups, and which number can be, for example, from about 1 to about 3, and more specifically 1, 2, or 3; n represents the number of segments, and is, for example, a number of from 1 to about 12, from 1 to about 6, from about 3 to about 6, and from 3 to 6.

Specific examples of ester thiols selected for incorporation into the photogenerating layer are represented by at least one of

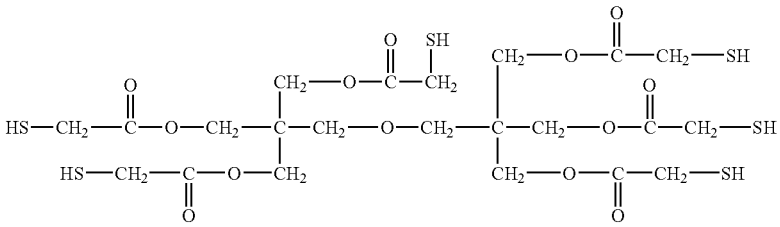

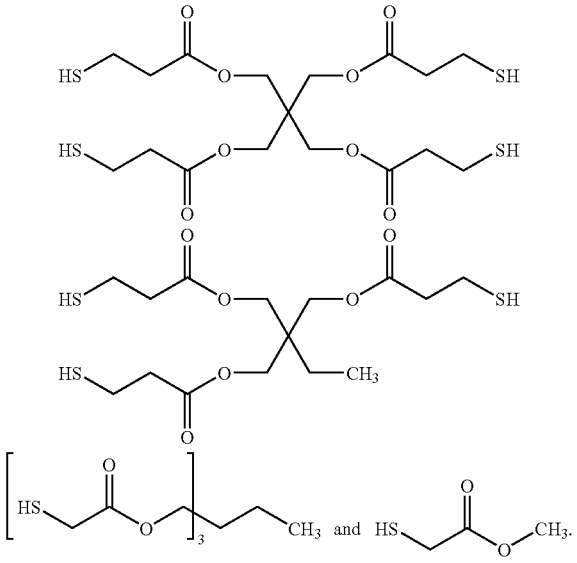

In embodiments, the ester thiol selected for the photogenerating layer mixture, and which thiol may function as a stabilizer for the polymer binder of the photogenerating layer includes dipentaerythritol hexakis(mercaptoacetate), pentaerythritol tetrakis(3-mercaptopropionate), trimethylolpropane tris(3-mercaptopropionate), trimethylolpropane tris(2-mercaptoacetate), and methyl mercaptoacetate present, for example, in an amount of from about 2 to about 15 weight percent of the photogenerating layer.

The photogenerating layer, in embodiments, is comprised of a mixture of the ester thiol as illustrated herein, at least one photogenerating component, and a binder. Examples of binders are poly(vinyl halide) such as poly(vinyl chloride) containing polymers or copolymers wherein vinyl chloride is present in an amount of from about 70 to about 99 weight percent, or from about 80 to about 95 weight percent based on the total monomer weight, and which poly(vinyl halide) possesses, for example, a number average molecular weight of from about 5,000 to about 100,000, or from about 10,000 to about 50,000.

Specific examples of poly(vinyl chloride) containing photogenerating polymers include copolymers of vinyl chloride/ vinyl acetate, carboxyl-modified copolymers of vinyl chloride/vinyl acetate, epoxy-modified copolymers of vinyl chloride/vinyl acetate, and hydroxyl-modified copolymers of vinyl chloride/vinyl acetate, all commercially available from Dow Chemical as UCAR™ (trademark of Union Carbide Corporation) Solution Vinyl Resins. Furthermore, specific examples of poly(vinyl chloride) containing polymers or copolymers are hydroxyl/carboxyl-modified copolymers of vinyl chloride/vinyl acetate, and sulfonate-modified copolymers of vinyl chloride/vinyl acetate, both commercially available from Dow Chemical as UCARMAG™ (trademark of Union Carbide Corporation).

Examples of photogenerating polymer binders of vinyl chloride/vinyl acetate include VYNS-3 (vinyl chloride/vinyl acetate in a ratio percent of 90/10 weight/weight, a number average molecular weight $M_n$ of about 44,000), VYHH (vinyl chloride/vinyl acetate in a ratio percent of 86/14 weight/weight, a number average molecular weight $M_n$ of about 27,000), and VYHD (vinyl chloride/vinyl acetate in a ratio percent of 86/14 weight/weight, a number average molecular weight $M_n$ of about 22,000).

Examples of photogenerating polymer binders of carboxyl-modified copolymers of vinyl chloride/vinyl acetate include VMCH (vinyl chloride/vinyl acetate/maleic acid in a ratio percent of 86/13/1 weight/weight/weight, a number average molecular weight $M_n$ of about 27,000), VMCC (vinyl chloride/vinyl acetate/maleic acid in a ratio percent of 83/16/1 weight/weight/weight, a number average molecular weight $M_n$ of about 19,000), and VMCA (vinyl chloride/vinyl acetate/maleic acid in a ratio percent of 81/17/2 weight/weight/weight, a number average molecular weight $M_n$ of about 15,000).

Examples of photogenerating polymer binders of epoxy-modified copolymers of vinyl chloride/vinyl acetate include VERR-40 (vinyl chloride/vinyl acetate/epoxy-containing monomer in a ratio percent of 82/9/9 weight/weight/weight, a number average molecular weight $M_n$ of about 15,000).

Examples of photogenerating polymer binders of hydroxyl-modified copolymers of vinyl chloride/vinyl acetate include VAGH (vinyl chloride/vinyl acetate/vinyl alcohol in a ratio percent of 90/4/6 weight/weight/weight, a number average molecular weight $M_n$ of about 27,000), VAGD (vinyl chloride/vinyl acetate/vinyl alcohol in a ratio percent of 90/4/6 weight/weight/weight, a number average molecular weight $M_n$ of about 22,000), VAGF (vinyl chloride/vinyl acetate/hydroxyalkyl acrylate in a ratio percent of 81/4/15 weight/weight/weight, a number average molecular weight $M_n$ of about 33,000), VAGC (vinyl chloride/vinyl acetate/hydroxyalkyl acrylate in a ratio percent of 81/4/15 weight/weight/weight, a number average molecular weight $M_n$ of about 24,000), and VROH (vinyl chloride/vinyl acetate/hydroxyalkyl acrylate in a ratio percent of 81/4/15 weight/weight/weight, a number average molecular weight $M_n$ of about 15,000).

Examples of photogenerating polymer binders of hydroxyl/carboxyl-modified copolymers of vinyl chloride/vinyl acetate include UCARMAG™ 527 (trademark of Union Carbide Corporation) (vinyl chloride/vinyl acetate/maleic acid and hydroxyalkyl acrylate in a ratio percent of 82/4/14 weight/weight/weight, a number average molecular weight $M_n$ of about 35,000).

Examples of photogenerating polymer binders of sulfonate-modified copolymers of vinyl chloride/vinyl acetate include UCARMAG™ 569 (trademark of Union Carbide Corporation) (vinyl chloride/vinyl acetate/sulfonate-containing monomer in a ratio percent of 85/13/2 weight/weight/weight, a number average molecular weight $M_n$ of about 17,000).

Any free radicals generated due to the thermal instability of the polymer binder, such as poly(vinyl chloride) copolymers, such as VMCH, are disadvantageous in some respects. With the ester thiol stabilized poly(vinyl chloride) copolymers in the photogenerating layer, there is involved the deactivation of unstable structural defects by the nucleophilic chloride displacement through thiol additions to polyene double bonds, and the prevention of autoacceleration during thermal dehydrochlorination through polyene shortening reactions, and the scavenging of free radicals formed from polyenes and HCl. An unusually facile displacement of labile chloride that is favored by thiol acidity can account, at least in part, for the relatively high effectiveness of the disclosed ester thiol as a stabilizer.

The photogenerating layer comprised of a mixture of an ester thiol, at least one photogenerating component, and a binder, can be prepared by (1) dispersing the photogenerating component in the binder first, and then adding the ester thiol; or (2) mixing the binder with the ester thiol, and then dispersing the photogenerating component in the mixture of the binder and the ester thiol; or (3) mixing the ester thiol with the photogenerating component, and then dispersing the mixture of the ester thiol and the photogenerating component in the binder.

Photoconductive Layer Components

There can be selected for the photoconductors disclosed herein a number of known layers, such as substrates, photogenerating layers, charge transport layers (CTL), hole blocking layers, adhesive layers, protective overcoat layers, and the like. Examples, thicknesses, specific components of many of these layers include the following.

The thickness of the photoconductor substrate layer depends on various factors, including economical considerations, desired electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 microns to about 300 microns, or from about 100 to about 150 microns. In embodiments, the photoconductor can be free of a substrate, for example the layer usually in contact with the substrate can be increased in thickness. For a photoconductor drum, the substrate or supporting medium may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

Also, the photoconductor may, in embodiments, include a blocking layer, an adhesive layer, a top overcoating protective layer, and an anticurl backing layer.

The photoconductor substrate may be opaque, substantially opaque, or substantially transparent, and may comprise any suitable material that, for example, permits the photoconductor layers to be supported. Accordingly, the substrate may comprise a number of known layers, and more specifically, the substrate can be comprised of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may comprise any suitable metal of, for example, aluminum, nickel, steel, copper, and the like, or a polymeric material filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer is to be rendered conductive, the surface thereof may be rendered electrically conductive by an electrically conductive coating. The conductive coating may vary in thickness depending upon the optical transparency, degree of flexibility desired, and economic factors, and in embodiments this layer can be of a thickness of from about 0.05 micron to about 5 microns.

Illustrative examples of substrates are as illustrated herein, and more specifically, supporting substrate layers selected for the photoconductors of the present disclosure comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, and more specifically, alkylhydroxyl gallium phthalocyanines, hydroxygallium phthalocyanines, chlorogallium phthalocyanines, perylenes, especially bis(benzimidazo)perylene, titanyl phthalocyanines, and the like, and yet more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume.

In embodiments, the photogenerating component or pigment is dispersed in the polymer binder and ester thiol mixture, and where the ester thiol functions primarily as a thermal stabilizer. Generally, however, from about 5 percent by volume to about 95 percent by volume of the photogenerating pigment is dispersed in about 95 percent by volume to about 5 percent by volume of the resinous binder mixture, or from about 20 percent by volume to about 30 percent by volume of the photogenerating pigment is dispersed in about 70 percent by volume to about 80 percent by volume of the stabilized resinous binder composition mixture. In one embodiment, about 90 percent by volume of the photogenerating pigment is dispersed in about 10 percent by volume of the resinous binder composition mixture, and which resin may be selected from a number of known poly(vinyl chloride) copolymers, such as copolymers of vinyl chloride/vinyl acetate, carboxyl-modified copolymers of vinyl chloride/vinyl acetate, epoxy-modified copolymers of vinyl chloride/vinyl acetate, hydroxyl-modified copolymers of vinyl chloride/vinyl acetate, hydroxyl/carboxyl-modified copolymers of vinyl chloride/vinyl acetate, and sulfonate-modified copolymers of vinyl chloride/vinyl acetate. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The optional hole blocking or undercoat layer or layers selected for the photoconductors of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 15 microns to about 40 microns. Examples of charge transport components are aryl amines of the following formulas/structures

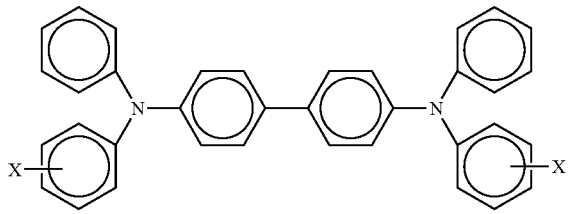

and

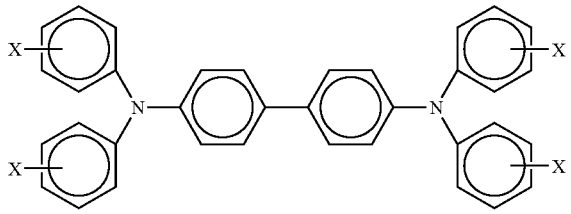

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

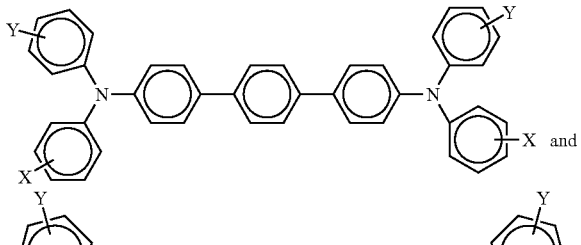

and

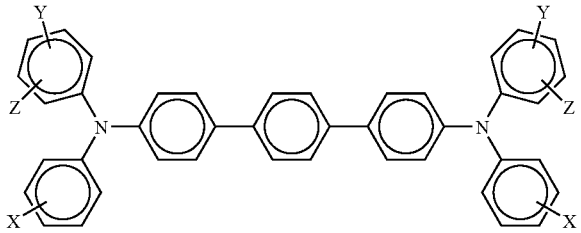

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Specific examples of hole transport layer components are represented by the following

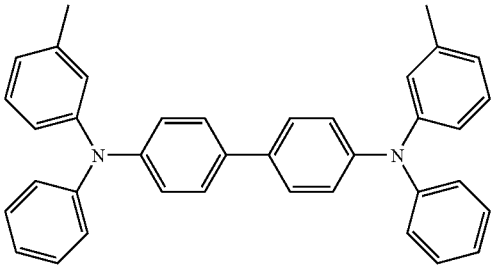

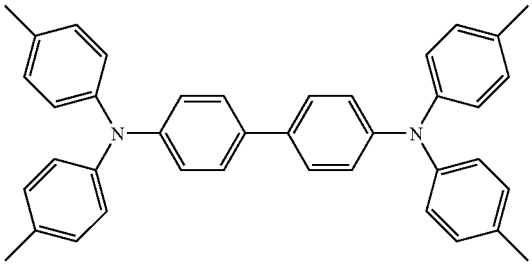

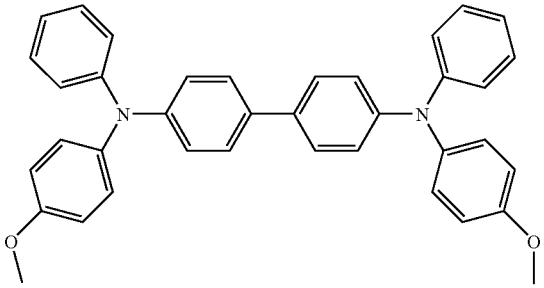

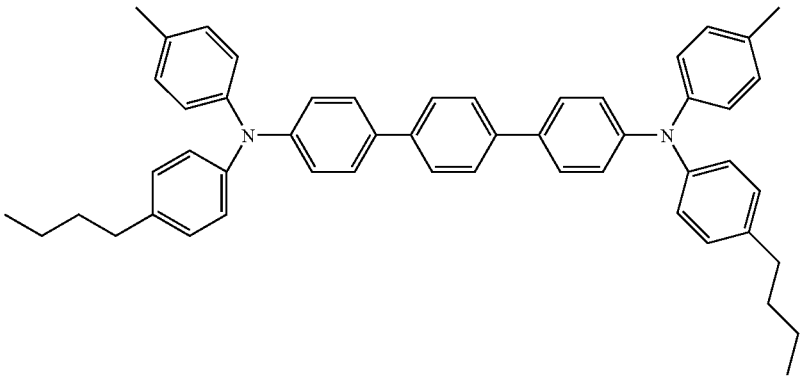

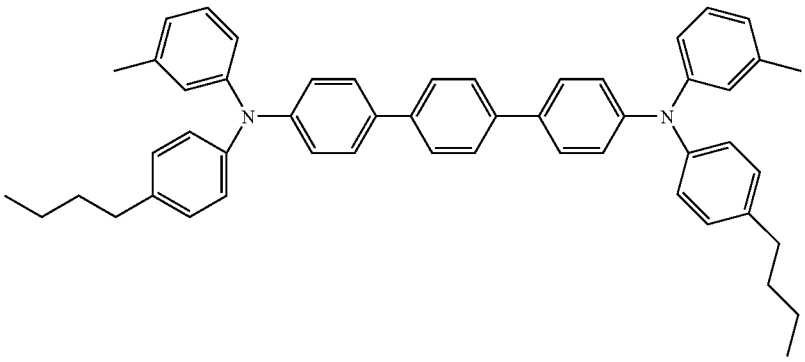

and

-continued

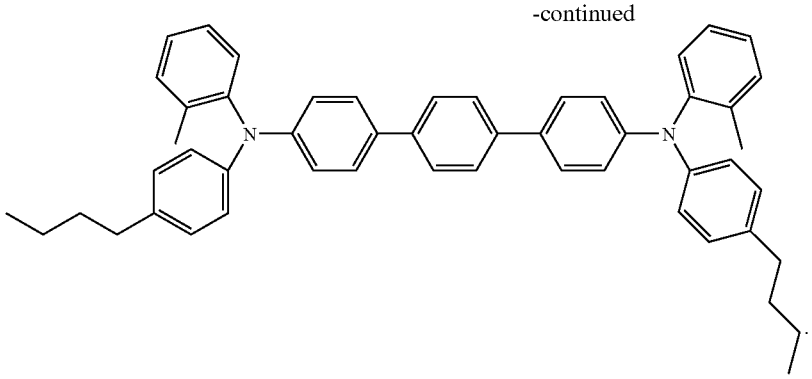

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present in the charge transport layer, or layers, for example, in an amount of from about 50 to about 75 weight percent include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes, for example, N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 5 to about 90 micrometers, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge the surface charge.

Examples of components or materials optionally incorporated into the charge transport layers, or at least one charge transport layer to, for example, enable excellent lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl -aminophenyl)]-phenylmethane (DHTPM), and the like. The weight percent of the antioxidant in at least one of the charge transport layers is from about 0 to about 20, from about 1 to about 10, or from about 3 to about 8 weight percent.

The following Examples are being submitted to illustrate embodiments of the present disclosure.

COMPARATIVE EXAMPLE 1

A 30 millimeter drum photoconductor was prepared as follows.

An undercoat coating solution was prepared by dissolving zirconium acetylacetonate tributoxide (ORGATICS™ ZC-540, available from Matsumoto Kosho Co., Japan, 35.5 grams), γ-aminopropyltriethoxysilane (4.8 grams) and polyvinyl butyral S-LEC™ BM-S (degree of polymerization is about 850, mole percent of vinyl butyral is equal to or greater than about 70, for example from about 70 to about 90, mole percent of vinyl acetate is about 4 to 6, mole percent of vinyl alcohol is about 25, available from Sekisui Chemical Co., Ltd., Tokyo, Japan, 2.5 grams) in n-butanol (52.2 grams). The coating solution was coated by a dip coater, and the layer was pre-heated at 59° C. for 13 minutes, humidified at 58° C. (dew point is about 54° C.) for 17 minutes, and dried at 135° C. for 8 minutes. The thickness of the undercoat layer was approximately 1.3 microns.

The photogenerating layer coating dispersion was prepared by mixing 2.7 grams of Type B chlorogallium phthalocyanine (ClGaPc) pigment with about 2.3 grams of polymeric binder VMCH (Dow Chemical), 30 grams of xylene, and 15 grams of n-butyl acetate. The mixture was milled in an attritor mill with about 200 grams of 1 millimeter Hi-Bea borosilicate glass beads for about 3 hours. The dispersion was filtered through a 20 μm Nylon cloth filter, and the solid content of the dispersion was diluted to about 5.8 weight percent with a mixture of xylene/n-butyl acetate, about 2/1 (weight/weight). The ClGaPcNMCH, about 54/46 photogenerating layer dispersion, was applied on top of the above undercoat layer. The thickness of the photogenerating layer was approximately 0.2 micron.

Subsequently, a 30 micron charge transport layer was coated on top of the photogenerating layer, which coating dispersion was prepared by dissolving and dispersing N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON® L-2 microparticle (1 gram) available from Daikin Industries in a solvent mixture of 20 grams of tetrahydrofuran (THF) and 6.7 grams of toluene via CAVIPRO® 300 nanomizer (Five Star Technology, Cleveland, Ohio). The charge transport layer was dried at about 120° C. for about 40 minutes.

COMPARATIVE EXAMPLE 2

A 30 millimeter drum photoconductor was prepared as follows.

A titanium oxide/phenolic resin undercoat layer dispersion was prepared by ball milling 15 grams of titanium dioxide (MT-150W, Tayca Company), and 10 grams of the phenolic resin (VARCUM™ 29159, OxyChem Company, $M_w$ of about 3,600, viscosity of about 200 cps) in 7.5 grams of 1-butanol and 7.5 grams of xylene with 120 grams of 1 millimeter diameter sized $ZrO_2$ beads for 5 days. The resulting titanium dioxide dispersion was filtered with a 20 micron Nylon cloth, and then the filtrate was measured with Horiba Capa 700 Particle Size Analyzer, and there was obtained a median $TiO_2$ particle size of 50 nanometers in diameter, and a $TiO_2$ particle surface area of 30 $m^2$/gram with reference to the above $TiO_2$/VARCUM™ dispersion. The $TiO_2$/VARCUM™ undercoat layer dispersion was coated and subsequently dried at 160° C. for 20 minutes, which resulted in an undercoat layer deposited on the aluminum, and comprised of $TiO_2$/VARCUM™ with a weight ratio of about 60/40 and a thickness of 10 microns.

The photogenerating layer coating dispersion was prepared by mixing 2.7 grams of Type B chlorogallium phthalocyanine (ClGaPc) pigment with about 2.3 grams of polymeric binder VMCH (Dow Chemical), 30 grams of xylene, and 15 grams of n-butyl acetate. The resulting mixture was milled in an attritor mill with about 200 grams of 1 millimeter Hi-Bea borosilicate glass beads for about 3 hours. The dispersion was filtered through a 20 μm Nylon cloth filter, and the solid content of the dispersion was diluted to about 5.8 weight percent with a mixture of xylene/n-butyl acetate, about 2/1 (weight/weight). The ClGaPcNMCH, about 54/46 photogenerating layer dispersion, was applied on top of the above undercoat layer. The thickness of the photogenerating layer was approximately 0.2 micron.

Subsequently, a 17 micron charge transport layer was coated on top of the photogenerating layer, which coating dispersion was prepared by dissolving and dispersing N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON® L-2 microparticle (1 gram) available from Daikin Industries in a solvent mixture of 20 grams of tetrahydrofuran (THF), and 6.7 grams of toluene via CAVIPRO® 300 nanomizer (Five Star technology, Cleveland, Ohio). The charge transport layer was dried at about 120° C. for about 40 minutes.

EXAMPLE I

A photoconductor was prepared by repeating the process of Comparative Example 1 except that the photogenerating layer coating dispersion was prepared by mixing 2.7 grams of Type B chlorogallium phthalocyanine (ClGaPc) pigment with about 2.3 grams of the polymeric binder VMCH (Dow Chemical), 0.25 gram of pentaerythritol tetrakis(3-mercaptopropionate), represented by

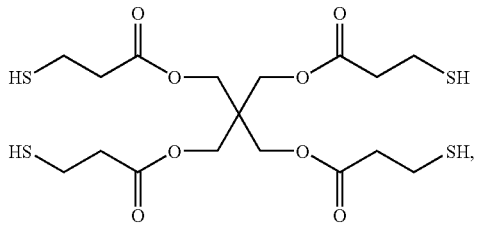

30 grams of xylene, and 15 grams of n-butyl acetate. The resulting mixture was milled in an attritor mill with about 200 grams of 1 millimeter Hi-Bea borosilicate glass beads for about 3 hours. The dispersion was filtered through a 20 μm Nylon cloth filter, and the solid content of the dispersion was diluted to about 6.1 weight percent with a mixture of xylene/n-butyl acetate, about 2/1 weight/weight. The ClGaPcNMCH/pentaerythritol tetrakis(3-mercaptopropionate) at a 51.4/43.8/4.8 ratio photogenerating layer dispersion was coated on top of the undercoat layer; and the thickness of the photogenerating layer was approximately 0.2 micron.

EXAMPLE II

A photoconductor was prepared by repeating the process of Comparative Example 2 except that the photogenerating layer coating dispersion was prepared by mixing 2.7 grams of Type B chlorogallium phthalocyanine (ClGaPc) pigment with about 2.3 grams of the polymeric binder VMCH (obtained from Dow Chemical), 0.30 gram of pentaerythritol tetrakis(3-mercaptopropionate), represented by

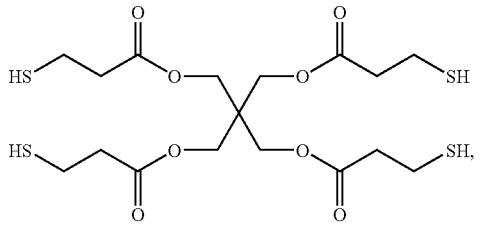

30 grams of xylene, and 15 grams of n-butyl acetate. The resulting mixture was milled in an attritor mill with about 200 grams of 1 millimeter Hi-Bea borosilicate glass beads for about 3 hours. The dispersion was filtered through a 20 μmg Nylon cloth filter, and the solid content of the dispersion was diluted to about 6.1 weight percent with a mixture of xylene/n-butyl acetate, 2/1 weight/weight. The ClGaPcNMCH/pentaerythritol tetrakis(3-mercaptopropionate) at a 51.3/43.8/4.9 ratio photogenerating layer dispersion was coated on top of the undercoat layer, and the thickness of the photogenerating layer was approximately 0.3 micron.

EXAMPLE III

A photoconductor is prepared by repeating the process of Example I except that there is included in the photogenerating layer 4.8 weight percent of dipentaerythritol hexakis(mercaptoacetate), trimethylolpropane tris(3-mercaptopropionate), trimethylolpropane tris(2-mercaptoacetate), or methyl mercaptoacetate in place of the pentaerythritol tetrakis(3-mercaptopropionate).

EXAMPLE IV

A photoconductor is prepared by repeating the process of Example II except that there is included in the photogenerating layer 4.8 weight percent of dipentaerythritol hexakis(mercaptoacetate), trimethylolpropane tris(3-mercaptopropionate), trimethylolpropane tris(2-mercaptoacetate), or methyl mercaptoacetate in place of the pentaerythritol tetrakis(3-mercaptopropionate).

Electrical Property Testing

The above prepared photoconductors of Comparative Examples 1 and 2, Examples I and II were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDC) from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Almost identical PIDC curves were generated for the photoconductors of Comparative Example 1 and Example I, also for Comparative Example 2 and Example II, respectively.

Ghosting Measurement

The Comparative Example 1 and Example I photoconductors were acclimated at room temperature for 24 hours before testing in A zone (85° F. and 80 percent humidity) for ghosting. Print testing was accomplished in the Xerox Corporation WorkCentre™ Pro C3545 using the K (black toner) station at t of 500 print counts (t equal to 0 is the first print; t equal to 500 is the $500^{th}$ print). At the CMY stations of the color WorkCentre™ Pro C3545, run-up from t of 0 to t of 500 print counts for the photoconductor was completed. Ghosting levels were visually measured against an empirical scale (from Grade 1 to Grade 6). The smaller the ghosting grade (absolute value), the better the print quality. The ghosting results are summarized in Table 1.

TABLE 1

| | Ghosting Grade at t of 0 | Ghosting at t of 500 prints |
|---|---|---|
| Comparative Example 1 | −1 | −3 |
| Example I | −1 | −1.5 |

After 500 prints, the ghosting level for the Example I photoconductor remained low at Grade −1.5; in contrast, the Comparative Example 1 photoconductor had an elevated ghosting level of Grade −3. Incorporation of the ester thiol into the photogenerating layer thus reduced ghosting by 50 percent.

The prints for determining ghosting characteristics includes a X symbol or letter on a half tone image. When X is barely visible, the ghost level is assigned $G_1$; $G_2$ to $G_5$ refers to the level of visibility of X; and $G_6$ refers to a dark and visible X.

Background/Charge Deficient Spot Measurement

The Comparative Example 2 and Example II photoconductors were acclimated at room temperature for 24 hours before testing in A zone (85° F./80 percent relative humidity) for background/charge deficient spot (CDS). Print testing was completed in the Xerox Corporation WorkCentre™ Pro C3545 using the black and white copy mode, and where there was achieved a machine speed of 165 millimeters/second at t equal to 0 for background/CDS. Background/CDS levels were visually measured against an empirical scale where the smaller the background/CDS grade level, the better the print quality. The results are shown in Table 2. More specifically, background/CDS is a measure of the percentage of grayness on white paper; $G_1$ is almost white; $G_7$ represents dark prints; $G_2$ to $G_5$ represent levels of grayness between $G_1$ and $G_6$.

TABLE 2

| | Background/CDS Grade |
|---|---|
| Comparative Example 2 | 2.5 |
| Example II | 1 |

Incorporation of the ester thiol into the photogenerating layer reduced background/CDS from a grade/value of 2.5 to a grade/value of 1, or an excellent 60 percent reduction in background/CDS.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport component, and wherein said photogenerating layer contains at least one photogenerating component, and a mixture of an ester thiol and a poly(vinyl halide) polymer, and wherein said thiol is represented by

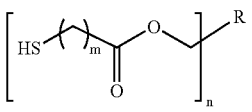

wherein R is at least one of hydrogen, alkyl, alkoxy, and aryl; n represents the number of repeating segments; and m represents the number of repeating groups.

2. A photoconductor in accordance with claim 1 wherein said mixture of said ester thiol and said poly(vinyl halide) polymer is present in an amount of from about 20 to about 80 weight percent.

3. A photoconductor in accordance with claim 1 wherein said mixture of said ester thiol and said poly(vinyl halide) is present in an amount of from about 30 to about 70 weight percent.

4. A photoconductor in accordance with claim 1 wherein said poly(vinyl halide) copolymer is a poly(vinyl chloride) copolymer, and said ester thiol is at least one of dipentaerythritol hexakis(mercaptoacetate), pentaerythritol tetrakis(3-mercaptopropionate), trimethylolpropane tris(3-mercaptopropionate), trimethylolpropane tris(2-mercaptoacetate), and methyl mercaptoacetate, and said at least one charge transport layer is 1 layer, 2 layers, or 3 layers.

5. A photoconductor in accordance with claim 1 wherein said poly(vinyl halide) copolymer is a poly(vinyl chloride) copolymer, and said ester thiol is dipentaerythritol hexakis (mercaptoacetate), or pentaerythritol tetrakis(3-mercaptopropionate), and said at least one charge transport layer is 1 layer, or 2 layers.

6. A photoconductor in accordance with claim 1 wherein m is 1, 2, or 3, and n is a number of from about 1 to about 12.

7. A photoconductor in accordance with claim 1 wherein m is 1, 2, or 3, and n is a number of from about 1 to about 6.

8. A photoconductor in accordance with claim 1 wherein m is 1, 2, or 3, and n is a number of from about 3 to about 6.

9. A photoconductor in accordance with claim 1 wherein m is 1, and n is a number of from about 3 to about 6.

10. A photoconductor in accordance with claim 1 wherein m is 1, 2, or 3, and n is a number of from about 1 to about 12, and R is alkyl.

11. A photoconductor in accordance with claim 1 wherein m is 1, 2, or 3, and n is a number of from about 1 to about 12, and R is aryl.

12. A photoconductor in accordance with claim 1 wherein m is 1, 2, or 3, and n is a number of from about 1 to about 12, and R is alkyl with from 1 to about 6 carbon atoms.

13. A photoconductor in accordance with claim 1 wherein m is 1, 2, or 3, and n is a number of from about 1 to about 6, and R is alkoxy with from 1 to about 6 carbon atoms.

14. A photoconductor in accordance with claim 1 wherein m is 1, 2, or 3, and n is a number of from about 1 to about 12, and R comprises substituted derivatives of alkyl, aryl, and alkoxy.

15. A photoconductor in accordance with claim 1 wherein alkyl and alkoxy possess from about 1 to about 20 carbon atoms; aryl contains from 6 to about 36 carbon atoms; and wherein m is 1, 2, or 3, and n is a number of from about 1 to about 10.

16. A photoconductor in accordance with claim 1 wherein said charge transport component is comprised of at least one of

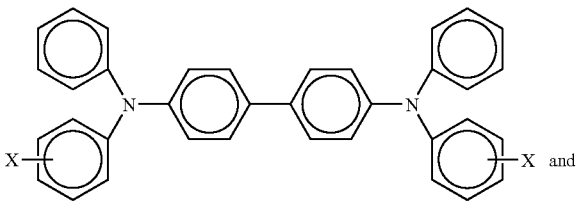

and

-continued

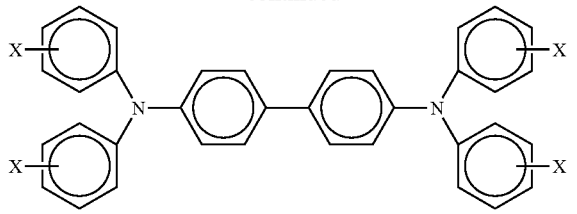

wherein X is selected from the group consisting of at least one of alkyl, alkoxy, aryl, and halogen.

17. A photoconductor in accordance with claim 1 wherein said charge transport component is comprised of

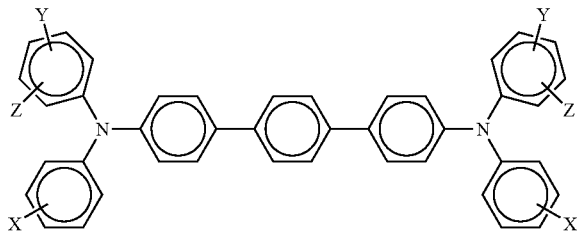

wherein X, Y and Z are independently selected from the group consisting of at least one of alkyl, alkoxy, aryl, and halogen, and at least one charge transport layer is 1 layer, or 2 layers.

18. A photoconductor in accordance with claim 1 wherein said charge transport component is an aryl amine selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N, N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4 ,4"-diamine, N,N'-diphenyl-N,N'-bis(3-chlorophenyl)-[p-terphenyl]-4,4"-diamine, and mixtures thereof; and wherein said at least one charge transport layer is 1 layer, 2 layers, or 3 layers.

19. A photoconductor in accordance with claim 1 further including in at least one of said charge transport layers an antioxidant comprised of at least one of a hindered phenolic and a hindered amine, and wherein said at least one charge transport layer is 1 layer or 2 layers.

20. A photoconductor in accordance with claim 1 wherein said photogenerating pigment is comprised of at least one of a perylene, a metal phthalocyanine, and a metal free phthalocyanine.

21. A photoconductor in accordance with claim 1 wherein said photogenerating pigment is comprised of at least one of chlorogallium phthalocyanine, hydroxygallium phthalocyanine, and titanyl phthalocyanine.

22. A photoconductor in accordance with claim 1 further including a hole blocking layer and an adhesive layer.

23. A photoconductor in accordance with claim 1 wherein said at least one charge transport layer is comprised of a top charge transport layer and a bottom charge transport layer, and wherein said top layer is in contact with said bottom layer, and said bottom layer is in contact with said photogenerating layer; and wherein said top and said bottom charge transport layers contain N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, or mixtures thereof; and said thiol is selected from the group consisting of

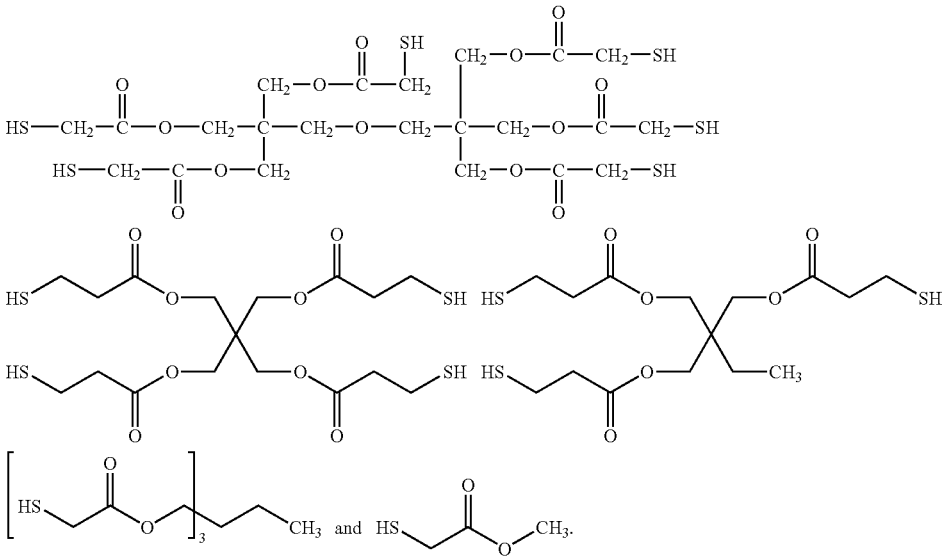

24. A photoconductor comprised in sequence of an optional supporting substrate, a photogenerating layer, and a charge transport layer; and wherein said photogenerating layer contains a mixture of a photogenerating pigment, a poly(vinyl chloride) copolymer, and an ester diol comprised of at least one of dipentaerythritol hexakis(mercaptoacetate), pentaerythritol tetrakis(3-mercaptopropionate), trimethylolpropane tris(3-mercaptopropionate), trimethylolpropane tris(2-mercaptoacetate), and methyl mercaptoacetate.

25. A photoconductor in accordance with claim 24 wherein said poly(vinyl chloride) copolymer is a copolymer of vinyl chloride, vinyl acetate, and maleic acid, and said thiol is pentaerythritol tetrakis(3-mercaptopropionate).

26. A photoconductor in accordance with claim 24 wherein said charge transport layer is comprised of a N,N'-diphenyl-N,N-bis(3-methylphenyl)-1,1'-biphenyl-4,4'-diamine, N,N'-bis(4-butylphenyl) -N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'bis-(2,5-dimethylphenyl)-[p-terphenyl]-4,4"-diamine, or N,N'-diphenyl-N,N'-bis(3-chlorophenyl)-[p-terphenyl]-4,4"-diamine; and which layer further includes a polymeric binder.

27. A photoconductor in accordance with claim 24 wherein said ester diol is represented by at least one of

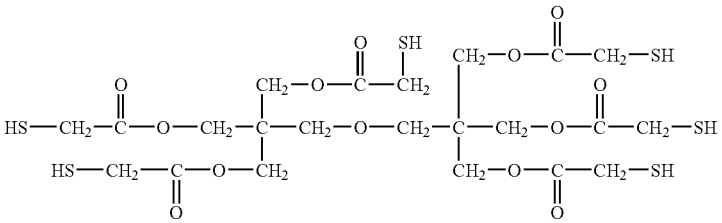

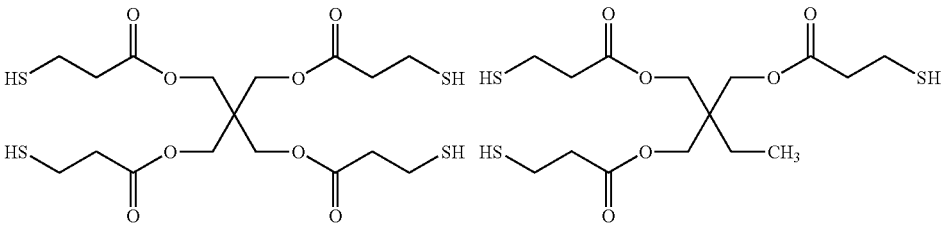

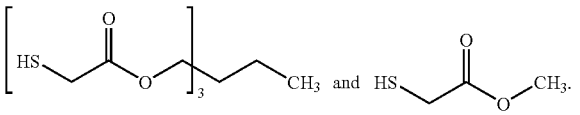

28. A photoconductor in accordance with claim 1 wherein said ester diol is represented by

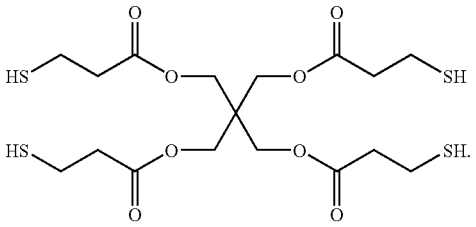

29. A process for the preparation of a photoconductor which comprises depositing on a supporting substrate a photogenerating layer followed by the depositing on said photogenerating layer of at least one charge transport layer wherein the photogenerating layer is prepared by mixing at least one photogenerating pigment, a poly(vinyl halide) copolymer, and an ester thiol as represented by

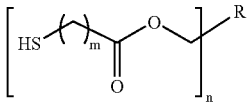

wherein R is selected from the group consisting of at least one of hydrogen, alkyl alkoxy, and aryl; n and m represent the number of repeating groups.

30. A process in accordance with claim 29 wherein said resulting photoconductor possesses minimal charge deficient spots; n is a number of from about 1 to about 12; and m is 1, 2, or 3.

31. A process in accordance with claim 29 wherein said resulting photoconductor possesses minimal ghosting characteristics; n is a number of from about 1 to about 12; and m is 1, 2, or 3.

32. A process in accordance with claim 29 wherein said ester thiol is at least one of dipentaerythritol hexakis(mercaptoacetate), pentaerythritol tetrakis(3-mercaptopropionate), trimethylolpropane tris(3-mercaptopropionate), trimethylolpropane tris(2-mercaptoacetate), and methyl mercaptoacetate.

* * * * *